US009052140B2

(12) United States Patent
Blomquist

(10) Patent No.: US 9,052,140 B2
(45) Date of Patent: Jun. 9, 2015

(54) METHOD FOR CONVERTING EXISTING KILN TO MULTI-PASS KILN

(71) Applicant: U.S. Natural Resources, Inc., Woodland, WA (US)

(72) Inventor: Christopher W. Blomquist, Ridgefield, WA (US)

(73) Assignee: USNR, LLC, Woodland, WA (US)

( * ) Notice: Subject to any disclaimer, the term of this patent is extended or adjusted under 35 U.S.C. 154(b) by 0 days.

(21) Appl. No.: 14/201,476

(22) Filed: Mar. 7, 2014

(65) Prior Publication Data

US 2014/0259729 A1 Sep. 18, 2014

Related U.S. Application Data

(60) Provisional application No. 61/802,307, filed on Mar. 15, 2013.

(51) Int. Cl.

| | |
|---|---|
| ***F26B 15/10*** | (2006.01) |
| ***F26B 15/16*** | (2006.01) |
| *F26B 25/08* | (2006.01) |
| *F26B 15/04* | (2006.01) |

(52) U.S. Cl.

CPC ..... *F26B 15/10* (2013.01); *F26B 15/16* (2013.01); *F26B 25/08* (2013.01); *Y10T 29/49716* (2015.01); *F26B 15/04* (2013.01)

(58) Field of Classification Search

CPC ..... F26B 3/04; F26B 15/10; F26B 25/08; F26B 2210/16; F26B 15/16; Y10T 29/49716; Y10T 29/53348

See application file for complete search history.

(56) References Cited

U.S. PATENT DOCUMENTS

| | | | |
|---|---|---|---|
| 1,353,591 | A | 9/1920 | Hope et al. |
| 1,784,727 | A | 12/1930 | Harris |
| 2,834,120 | A | 5/1958 | Greenwood |
| 4,182,048 | A | 1/1980 | Wolfe et al. |
| 4,955,146 | A | 9/1990 | Bollinger |
| 5,138,773 | A | 8/1992 | Goodwin et al. |

(Continued)

FOREIGN PATENT DOCUMENTS

| | | | |
|---|---|---|---|
| CA | 2821733 | A1 | 6/2012 |
| CA | 2847005 | A1 | 6/2014 |

(Continued)

OTHER PUBLICATIONS

Notice of Allowance for U.S. Appl. No. 14/201,722 mailed May 30, 2014.

(Continued)

*Primary Examiner* — Jermie Cozart

(74) *Attorney, Agent, or Firm* — Schwabe, Williamson & Wyatt

(57) ABSTRACT

Embodiments provide a multi-pass kiln with two or more chambers, an entrance and an exit at a proximal end of the kiln, and a reciprocal flow path extending through the kiln from the entrance to the exit. Lumber charges traveling along the reciprocal flow path may travel in a first direction along one side of the heated second chamber before traveling in a substantially opposite second direction along the opposite side of the second chamber. The distal end of the kiln may be substantially sealed, and a pressure differential between the distal end and the proximal end may draw moist heated air from the heated chamber toward the exit and entry to preheat and/or condition lumber charges traveling through the first chamber.

19 Claims, 11 Drawing Sheets

(56) References Cited

U.S. PATENT DOCUMENTS

| | | | |
|---|---|---|---|
| 5,195,251 | A | 3/1993 | Gyurcsek et al. |
| 5,414,944 | A | 5/1995 | Culp et al. |
| 6,119,364 | A | 9/2000 | Elder |
| 6,219,937 | B1 | 4/2001 | Culp et al. |
| 6,243,970 | B1 | 6/2001 | Culp et al. |
| 6,467,190 | B2 | 10/2002 | Nagel et al. |
| 6,601,317 | B2 | 8/2003 | Nardi |
| 7,849,894 | B2 | 12/2010 | Strebig et al. |
| 7,963,048 | B2 | 6/2011 | Pollard |
| 7,987,614 | B2 | 8/2011 | Erickson |
| 8,201,501 | B2 | 6/2012 | Tinsley et al. |
| 8,342,102 | B2 | 1/2013 | Tinsley et al. |
| 2006/0207686 | A1 | 9/2006 | Strebig et al. |
| 2006/0272172 | A1 | 12/2006 | Pollard |
| 2008/0066340 | A1 | 3/2008 | Kakuno |
| 2011/0056087 | A1 | 3/2011 | Tinsley et al. |
| 2012/0023772 | A1 | 2/2012 | Abramov et al. |
| 2012/0227276 | A1 | 9/2012 | Tinsley et al. |
| 2013/0305560 | A1 | 11/2013 | Jenkins et al. |
| 2014/0104579 | A1 | 4/2014 | Blomquist et al. |
| 2014/0138290 | A1 | 5/2014 | Saastamo et al. |

FOREIGN PATENT DOCUMENTS

| | | | |
|---|---|---|---|
| DE | 102005049276 | A1 | 4/2007 |
| EP | 0730130 | A1 | 9/1996 |
| EP | 2138301 | A1 | 12/2009 |
| GB | 718143 | | 11/1954 |
| JP | 2013078286 | A | 5/2013 |
| WO | 2014/150080 | A1 | 9/2014 |
| WO | 2014/150082 | A1 | 9/2014 |

OTHER PUBLICATIONS

U.S. Appl. No. 14/201,722, filed Mar. 7, 2014 (unpublished).

Office Action issued by the Canadian Intellectual Property Office for CA 2,846,731 mailed Jun. 25, 2014.

International Search Report and Written Opinion issued by the Korean Intellectual Property Office for PCT/US2014/022148 mailed Jun. 25, 2014.

International Search Report and Written Opinion issued by the Korean Intellectual Property Office for PCT/US2014/022145 mailed Jul. 7, 2014.

Office Action issued by the Canadian Intellectual Property Office for CA 2,847,005 mailed Jun. 19, 2014.

Canadian Examiner's Report for 2,846,731, mailed Dec. 29, 2014.

Canadian Examiner's Report for 2,847,005, mailed Dec. 29, 2014.

Canadian Examiner's Report for 2,847,005, mailed Apr. 13, 2015.

METHOD FOR CONVERTING EXISTING KILN TO MULTI-PASS KILN

CROSS REFERENCE TO RELATED APPLICATION

The present application claims priority to U.S. patent application Ser. No. 61/802,307, filed Mar. 15, 2013, and titled "MULTI-PASS LUMBER KILNS," the entire disclosure of which is hereby incorporated by reference.

TECHNICAL FIELD

Embodiments herein relate to the field of lumber drying, and, more specifically, to methods and systems for drying wood products in a kiln with a reciprocal flow path along which charges are moved through one side of the kiln in a first direction before being moved through an opposite side of the kiln in an opposite second direction.

BACKGROUND

Green lumber is typically stacked, grouped in batches, and dried batch-wise in a kiln. The batches of lumber ("charges") are placed within an insulated chamber in the kiln, the chamber is closed, and conditions within the chamber (e.g., air temperature, air flow direction/speed, and humidity) are maintained according to predetermined parameters based on factors such as lumber type, lumber thickness, and the starting moisture content of the lumber. The insulated chamber must be opened to remove the dried lumber and to insert the next batch of green lumber, requiring a readjustment of the temperature and other conditions within the chamber between successive batches of lumber.

Some mills have begun to use continuous kilns that include a central heating zone with a preheating/cooling zone at each end. The preheating/cooling zones are typically of equal length, and are typically 70 to 100% of the length of the central heating zone. Two parallel paths extend through the three zones. Green lumber traveling toward the drying chamber on one path is preheated by heat from dried lumber exiting the drying chamber along the other path, and by moist heated air from the drying chamber. The dried lumber exiting the heating zone is conditioned by the moisture released by the green lumber and by the moist heated air received from the drying chamber.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1A:
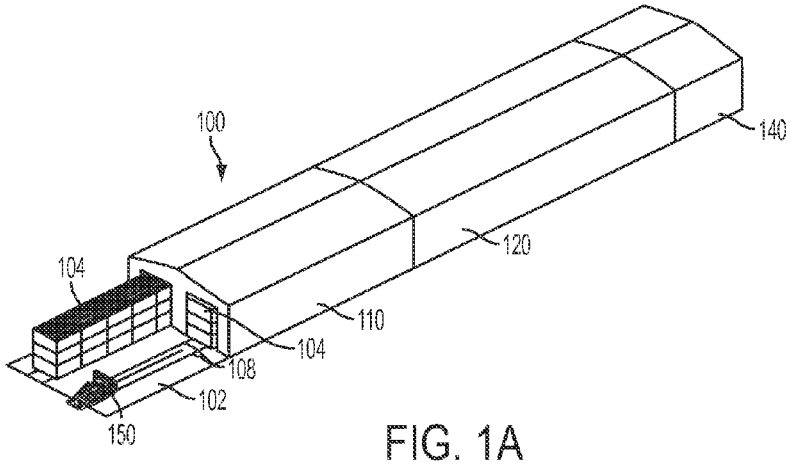
FIGS. 1A-D illustrate perspective views of multi-pass kilns.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "NB" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

In various embodiments, methods, apparatuses, and systems for drying lumber products are provided. In exemplary embodiments, a computing device may be endowed with one or more components of the disclosed apparatuses and/or systems and may be employed to perform one or more methods as disclosed herein.

Lumber is typically dried in a kiln to reduce the moisture content of the wood to within an acceptable range. Lumber loses or gains moisture until reaching anequilibrium moisture content (EMC). The EMC is a function of the temperature and relative humidity of the surrounding air—as the temperature increases and/or the relative humidity decreases, the EMC decreases and the lumber loses additional moisture. Therefore, the moisture content of lumber can be decreased by adjusting temperature and humidity within the kiln. However, sudden changes in these conditions can cause the outer surfaces of the lumber to dry and shrink more rapidly than interior portions, resulting in cracks and warping.

U.S. Pat. No. 7,963,048 discloses a dual path lumber kiln in which lumber flows through three zones (two unheated end zones and a heated middle zone) along one of two opposing paths with opposite directions of flow. Each end of the kiln includes the exit portal of one path and the entry portal of the other path. As dried lumber exits the drying chamber and proceeds toward the exit on one path, green lumber is traveling toward the drying chamber on the other path. The green lumber is gradually preheated by heat released by the dried lumber, and also by the condensation of water vapor (steam) from the drying chamber, which effects a transfer of energy to the lumber. In turn, the moisture released into the air by the preheated green lumber (and by the drying chamber) serves to condition the dried lumber as it cools.

This dual path design requires a relatively large footprint. Typical lengths for the heated chamber in the dual path design range from 96 ft to 185 ft, and each of the unheated chambers adds another 70-100% of that length. The rate at which lumber charges are transported through the heated chamber depends in part on the length of the heated chamber. In addition to the length added by the unheated sections extending from both ends of the heated section, space must also be reserved for stacking dried lumber or green lumber at both entrances and exits. The inclusion of two charge portals at each end also allows heat and moisture to be lost at an undesirable rate, decreasing the efficiency of the system.

The present disclosure provides single-path multi-pass kilns with a comparatively smaller footprint and/or improved drying efficiency. A single-path multi-pass kiln may have a path of flow that circulates through a heated chamber twice, thereby functionally extending the length of the heated chamber (and the rate at which lumber charges can be moved through the heated chamber) without increasing the physical length of the heated chamber.

In one embodiment, a kiln may include an unheated chamber coupled to a heated chamber to form a continuous enclosure, two charge portals in or near the unheated chamber, and a reciprocal flow path that passes through the chambers from one charge portal to the other charge portal. Optionally, a third chamber may be coupled to the distal end of the heated chamber, and the reciprocal flow path may pass at least partially through the third chamber. The third chamber may be an unheated chamber/zone that is used for transferring lumber from one side of the kiln to the other side in order to prevent heat and moisture loss. In other embodiments, the lumber may be transferred from one side of the kiln to the other side within the heated chamber. The distal end of the kiln may be closed to prevent the loss of heat and steam through that end. In still other embodiments, the lumber may be transferred from one side of the kiln to the other side by exiting the distal end of the kiln, moving along an exterior track, and entering the distal end of the kiln again.

A "flow path" is a path along which a movable support for a lumber charge travels through a kiln. The term "reciprocal flow path" is defined herein as a flow path that passes through a chamber or section of the kiln at least twice in substantially opposite directions of travel. Typically, a reciprocal flow path includes a first portion positioned on one side of the kiln, a substantially parallel second portion positioned on the opposite side of the kiln, and a third (connector) portion that connects the first and second portions to form an open loop. In some embodiments, the connector portion or some part thereof may be slideable, pivotable, or otherwise movable. In other embodiments, the connector portion may include a portion of track that extends transverse to the first and second portions. Thus, a lumber charge traveling along a reciprocal flow path can enter at kiln at a first terminal end and proceed along one side of the kiln toward the opposite terminal end, then move on or along the connector portion to the other side of the kiln, and continue along the reciprocal flow path in the opposite direction toward an exit in or near the first terminal end of the kiln.

FIGS. 1A-D illustrate perspective views of embodiments of a single-path multi-pass kiln. Kiln 100 may include a first chamber 110 coupled to a second chamber 120 to form an elongated enclosure. Kiln 100 may also include a support surface 102, a guide member 108, and at least one transport assembly 150. In some embodiments, kiln 100 may have a third chamber 140 (see e.g., FIGS. 1A and 1B).

The dimensions of first and second chambers 110 and 120 can vary among embodiments. In conventional continuous flow kilns, the end sections are commonly about 70% of the length of the central heated chamber. In contrast, some embodiments of a reciprocal flow path kiln may have end sections (first chamber 110/third chamber 140) that are shorter than in conventional kilns. Closing the distal end of the kiln may help to concentrate heat and steam in first chamber 110, allowing first chamber 110 to pre-heat/condition lumber more efficiently than in conventional kilns. Thus, in some embodiments, first chamber 110 may be 30-50%, 50-60%, or 60-70% of the length of second chamber 120. However, in other embodiments, first chamber 110 may be 70-100% or 100-150% of the length of second chamber 120. Typically, first chamber 110 has a length of 40 to 100 feet, 50 to 90 feet, 60 to 80 feet, or 65 to 75 feet. However, first chamber 110 can have any suitable length.

The length of second chamber 120 can be 40 to 160 feet, 40 to 80 feet, 50 to 90 feet, 90 to 150 feet, 100 to 140 feet, or 110 to 130 feet. Optionally, second chamber 120 may be a pre-existing kiln or portion thereof. In a particular embodiment, first chamber 110 has a length of 68 to 72 feet and second chamber 120 has a length of 115 to 125 feet. The chambers may be joined end-to-end to form a continuous enclosure. Some embodiments may include one or more internal walls or baffle within a chamber or between two chambers to control heat exchange between adjacent areas.

As shown in FIGS. 1*a-b* and 2*a-b*, some kilns may include a third chamber 140 coupled to second chamber 120. Optionally, third chamber 140 may be provided with one or more fans and/or heaters. Third chamber 140 may have a length that is equal to, or less than, the length of first chamber 110. For example, the length of third chamber 140 may be 10 to 70 feet, 10 to 40 feet, 10 to 20 feet, 20 to 30 feet, 15 to 50 feet, or 12 to 18 feet. In a particular embodiment, the sum of the lengths of first chamber 110 and third chamber 140 is less than the length of second chamber 120. In another embodiment, the combined lengths of the chambers is 120 to 220 feet (i.e., linear distance from the proximal end of first chamber 110 to the distal end of the most distal chamber of the kiln).

Support surface 102 may form the floor of kiln 100. Optionally, support surface may extend beyond first chamber 110 and/or second chamber 120. Support surface 102 can be constructed from concrete or any other type of material suitable for use in a lumber kiln.

Guide member 108 may be coupled to support surface 102. Guide member 108 can include one or more tracks, guide members, and/or rails. Guide member 108 may be mounted to, and/or at least partially embedded in, support surface 102. In some embodiments, guide member 108 or another guide member may be provided above or beside the reciprocal flow path.

Figure 4A:
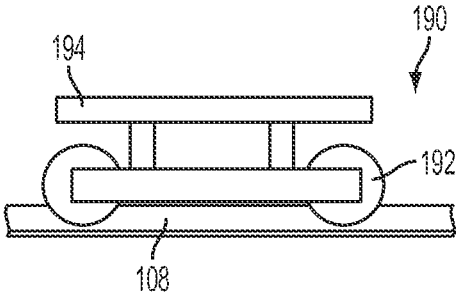
FIGS. 4A-B illustrate schematic elevational and plan views, respectively, of a movable support for a lumber charge.
Figure 4B:
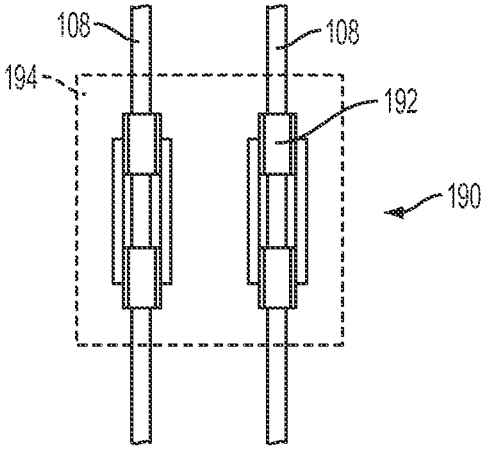

One or more movable supports 190 (see FIGS. 4A-B) may be coupled to guide member(s) 108. Movable support 190 may include a support surface coupled to one or more rotatable members. For example, movable support 190 may include a platform 194 mounted on guide member couplers 192 that are configured to engage the top/side of guide member 108. Guide member couplers 192 can be rotatable members (e.g., wheels), rigid or slideable members (e.g., pins), or other elements known in the art for movably coupling a platform to a rail, track, or the like. In any case, guide member 108 may guide the movable supports along the reciprocal flow path through the kiln. Therefore, guide member 108 may define the reciprocal flow path or portions thereof.

Transport assembly 150 may be coupled to movable support 190 and/or to guide member 108. Transport assembly 150 may be disposed over, under, or next to guide member 108. Transport assembly 150 can be any mechanism or device configured to push or pull one or more movable supports 190 along the reciprocal flow path. In some embodiments, transport assembly 150 may include a motor or a pulley/winch coupled to movable support 190. In other embodiments, transport assembly 150 may be coupled to guide member 108. For example, the motive force mechanism may include an endless loop (e.g., a chain or belt mounted on sprockets/wheels) that extends between the first and third portions of guide member 108. Movable supports 190 may be connected to the endless loop, which may be driven to transport the lumber charges through the kiln along guide member 108.

Optionally, transport assembly 150 may be a pusher device as described in U.S. Pat. No. 8,201,501, the full disclosure of which is hereby incorporated by reference. Essentially, this pusher device is configured to travel along a track that includes two parallel rails and a chain extending between the rails. The pusher device includes a frame with a front-mounted vertical plate, axle supports, transverse support struts, and rotatably-mounted toothed gears. An axle is mounted to the frame via the axle supports, and the transverse support struts support a variable speed electric motor. A large wheel and two pulleys are mounted on the axle. The output of the electric motor is connected to the large wheel by a chain or belt. The electric motor rotates the wheel, the wheel transmits motion to the axle, the axle rotates the pulleys, and the pulleys transmit rotary motion to the toothed gear(s). The toothed gear(s) engage a link chain positioned between two rails. Rotation of the toothed gears while engaged with the link chain propels the pusher device along the pair of rails. A cable connects a source of current to the electric motor, and is carried and tensioned on a spool rotatably mounted to the housing.

Lumber may be placed onto movable support 190, and movable support 190 may be pushed, pulled, or otherwise moved in the direction of flow by transport assembly 150, and guided through the kiln along the reciprocal flow path by guide member 108. In some embodiments, two or more first transport assemblies 150 may be provided to move the movable supports 190 along portions of the reciprocal flow path.

Referring now to FIGS. 1A, 1C, 2A, and 2C, first chamber 110 may have a pre-heat side with a first charge entry portal 112 and a cooling side with a first charge exit portal 114. In these embodiments, first charge entry portal 112 may be an entry portal for charges proceeding into kiln 100 and first charge exit portal 114 may be an exit portal for charges exiting kiln 100. In some embodiments, the only venting of the kiln is through the first charge entry and exit portals 112 and 114. In other embodiments, one or more vents may be provided in first chamber 110 and/or third chamber 140 to controllably regulate the temperature and manage any condensation or moisture congregation that may occur.

Alternatively, as shown in FIGS. 1B, 1D, 2B, and 2D, first chamber 110 may lack either the pre-heat side or the cooling side and the corresponding portal. Optionally, first chamber 110 may have a width that is substantially half the width of second chamber 120. First chamber 110 may include first charge entry portal 112 and second chamber 120 may include first charge exit portal 114.

FIGS. 2A-2D show block diagrams of embodiments of a reciprocal flow path within kiln 100. Again, in some embodiments guide member 108 may define the reciprocal flow path (e.g., where guide member 108 includes tracks or rails along support surface 102). Therefore, the following description of portions of the reciprocal flow path may also apply to corresponding portions of guide member 108. The reciprocal flow path may include a first portion 122 that extends between first charge entry portal 112 and second chamber 120 on a first side of kiln 100, a second portion 126 that extends between second chamber 120 and first charge exit portal 114 on the second side of kiln 100, and a connector portion 124 that connects first portion 122 to second portion 126. Thus, path 108 may define a single path of travel that passes through one side of kiln 100 in a first direction of travel (Arrow A) before passing through the second side of kiln 100 (or portion thereof) in a substantially opposite second direction of travel (Arrow B).

In some embodiments, connector portion 124 may be curved. Referring now to FIGS. 1B, 1D, 2B, and 2D, connector portion 124 may include a curved rail or track that is connected at a first end to first portion 122 and connected at a second end to second portion 126. In operation, a first transport assembly 150 may be positioned outside the kiln near first charge entry portal 112. The first transport assembly may be used to move a movable support 190 through the first side of kiln 100 along first portion 122. In some embodiments, the first transport assembly may move with the movable support 190 through the kiln. In other embodiments, the first transport assembly may move successive movable supports toward first charge entry portal 112, resulting in a series of movable supports being moved through the kiln in a train-like fashion.

Figure 1B:
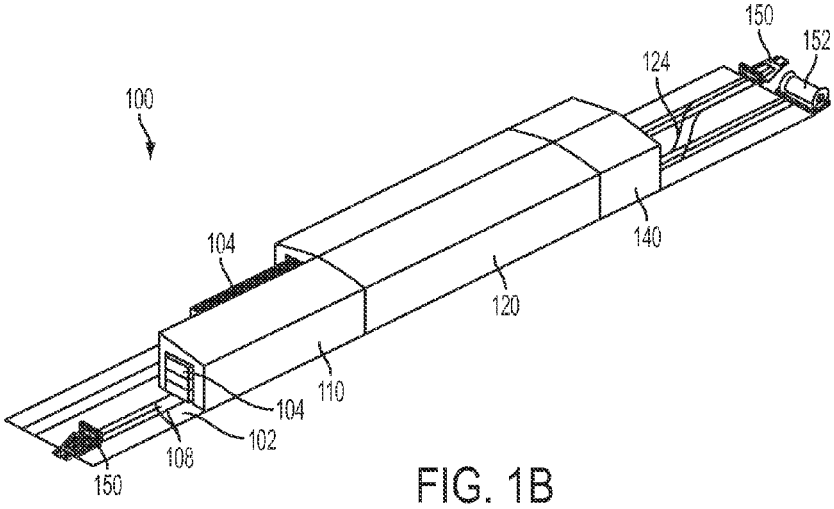
Figure 7A:
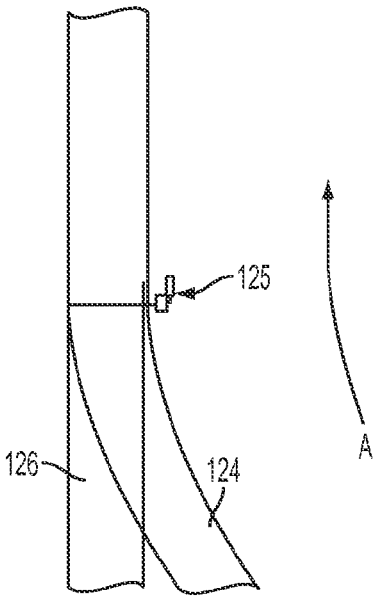
FIGS. 7A and 7B illustrate a schematic diagram of a switching mechanism, all in accordance with various embodiments.
Figure 7B:
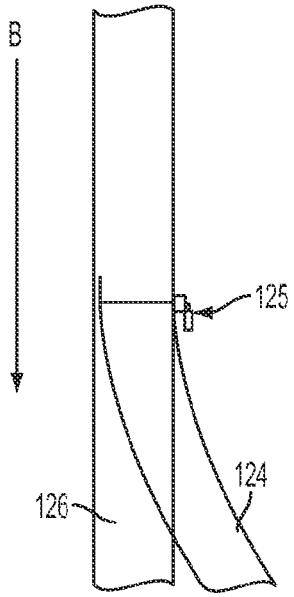

As best viewed in FIG. 1B, movable support 190 may be moved past an intersection of first portion 122 and connector portion 124 toward a second transport assembly 150. Optionally, movable support 190 may be moved past the intersection by a predetermined distance (e.g., a distance in the range of about 1-3 times the length of the lumber charge or movable support). Second transport assembly 150 may then move the movable support 190 in the opposite direction onto second portion 126. In some embodiments, a switching mechanism may be provided at the intersection of first portion 122 and connector portion 124. FIGS. 7A and 7B illustrate a schematic diagram of a switching mechanism 125. Switching mechanisms are known in the art and will not be further described herein.

The second transport assembly 150 may move the movable supports 190, individually or in series, along connector portion 124 to second portion 126. Again, a switching mechanism may be provided at the intersection of connector portion 124 and second portion 126. The switching mechanism(s) may be controlled manually by an operator. Alternatively, the switching mechanism(s) may be coupled to a computer system and controlled automatically based on data received by the computer system from one or more sensors (e.g., from one or more photo-eyes, visual cameras, scanners, etc.)

Alternatively, the orientation of connector portion 124 may be reversed with reference to first and second portions 122/126, and the second transport assembly 150 may be provided at a downstream end of second portion 126. The movable supports 190 may be moved directly onto and along connector portion 124 from first portion 122 without reversing direction. Once a movable support has been pushed onto second portion 126 from connector portion 124, the second transport assembly 150 may push the movable support in the opposite direction along second portion 126 toward first chamber 110. As another alternative, connector portion 124 may include two curved portions that intersect downstream of the first and second portions 124/126. Other configurations of connector portion 124 will be readily apparent to persons skilled in the art, and are encompassed by the present disclosure.

Figure 1C:
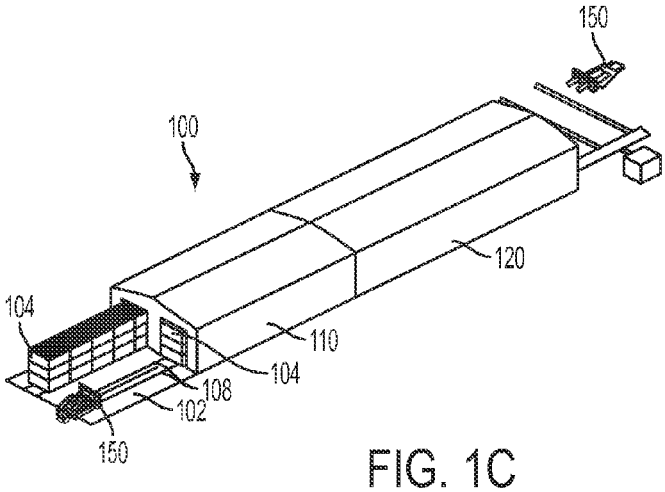
Figure 1D:
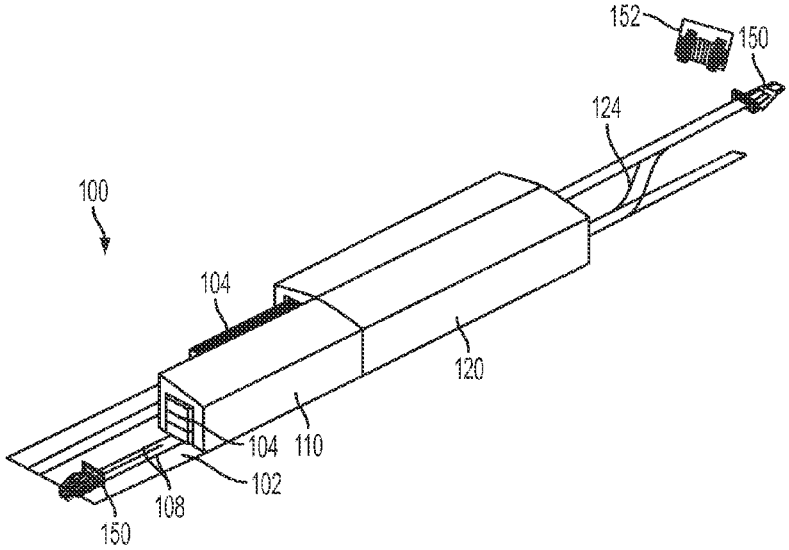
Figure 2A:
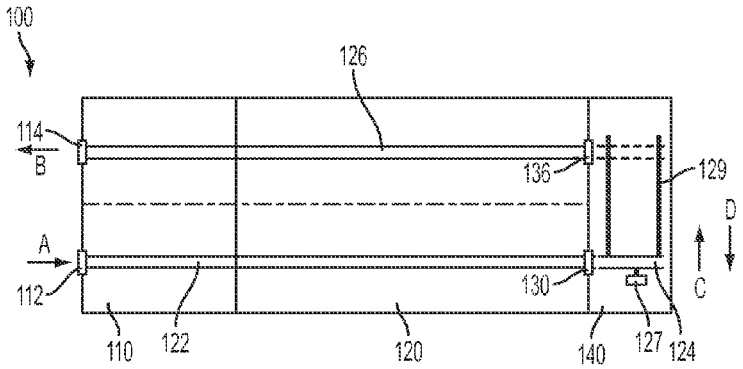
FIGS. 2A-F show block diagrams of reciprocal flow paths within multi-pass kilns as illustrated in FIGS. 1A-D (FIGS. 2A-D) and block diagrams of alternate flow paths within multi-pass kilns (FIGS. 2E-F)

In other embodiments, connector portion 124 may be slideable or otherwise movable between first portion 122 and second portion 126. For example, as best shown in FIGS. 1C and 2A, connector portion 124 may include a set of rails or tracks that are mounted to a carriage 129. An actuator 127 may be coupled to connector portion 124 and/or to carriage 129. Carriage 129 may include, for example, one or more rails positioned generally perpendicular to first portion 122. Actuator 127 can be, but is not limited to, a hydraulic actuator and/or a motor. Actuator 127 may be selectively actuable to move connector portion 124 and/or carriage 129 between a first position, in which connector portion 124 is aligned with an output end of first portion 122, and a second position, in which connector portion 124 is aligned with an input end of second portion 124.

In operation, one or more movable supports 190 may be moved from first portion 122 onto connector portion 124. Actuator 127 may move connector portion 124 on/along carriage 129 in direction C (FIG. 2A) and into the second position. Optionally, a second transport assembly 150 may be positioned to move the movable support(s) 190 from connector portion 124 onto second portion 126. Actuator 127 may then move connector portion 124 in direction D (FIG. 2A) from the second position to the first position.

Figure 2B:
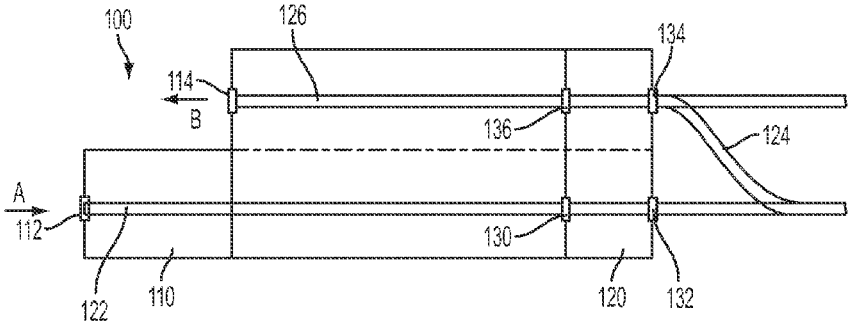
Figure 2C:
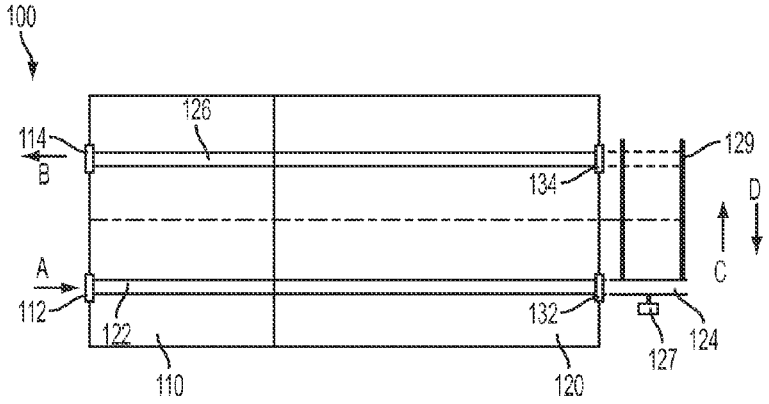
Figure 2D:
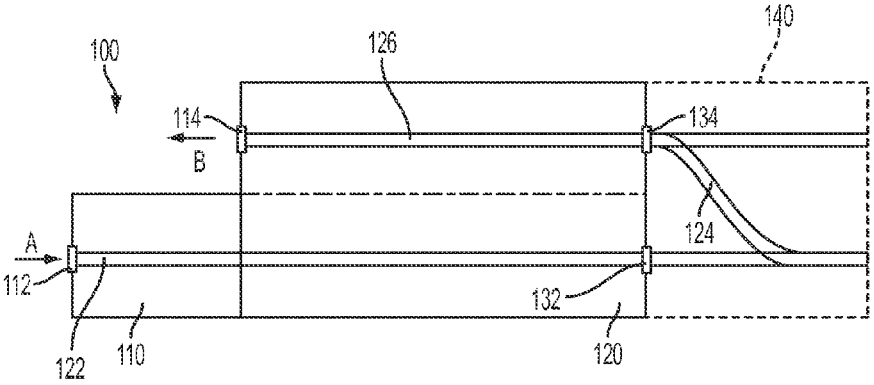
Figure 2E:
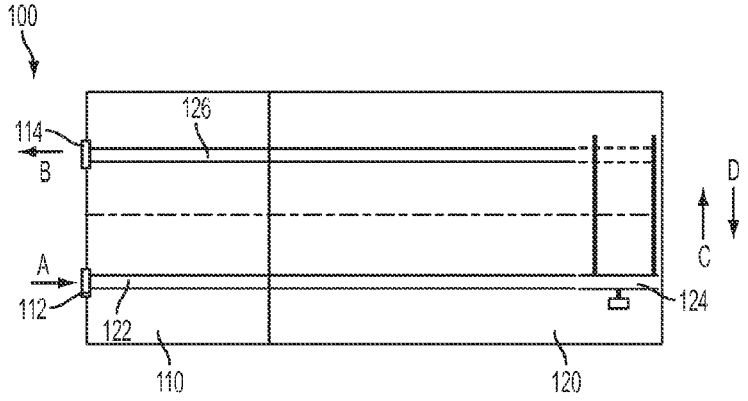
Figure 2F:
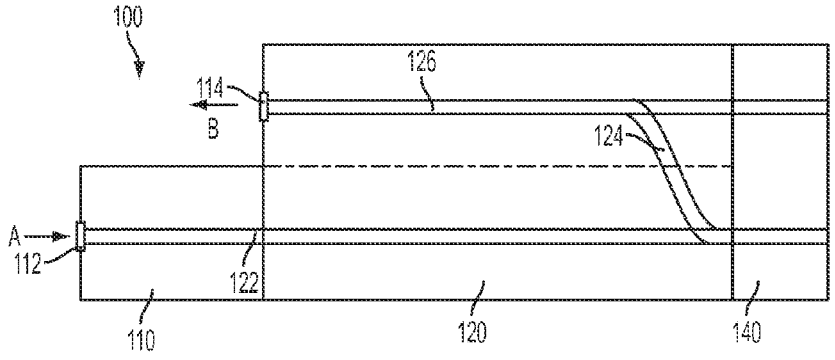

Connector portion 124 may be disposed at least partially within second chamber 120 (see e.g., FIGS. 2E-F). Alternatively, connector portion 124 may be disposed at least partially within third chamber 140 (see e.g., FIGS. 2A, 2D, and 2F). In these embodiments, the terminal end of kiln 100 may lack exit/entry portals, or such portals may be sealed during normal operation of the kiln to prevent loss of heat and steam from the distal end of the kiln.

In other embodiments, connector portion 124 may be disposed at least partially outside of kiln 100 (see e.g., FIGS. 2B, 2C, and 2D). In those embodiments, kiln 100 may be provided with a second charge exit portal 132 and second charge entry portal 134 at the distal end of the kiln (see e.g., FIGS. 2B-D). Lumber charges may be moved through the first side of the kiln along first portion 122 and exit the kiln through second charge exit portal 132. The lumber charges may then move along connector portion 124 to second portion 126, proceeding through second charge entry portal 134 to re-enter the kiln on the opposite side of the kiln.

Optionally, one or more intermediate charge portals 130/136 may be positioned between two chambers. For example, intermediate charge portals 130/136 may be provided between second chamber 120 and third chamber 140.

One or more of the entry charge portals, exit charge portals, and intermediate charge portals may include an insulating member that helps to minimize the passage of heat/steam from a chamber. For example, embodiments of a kiln 100 with a third chamber 140 may have intermediate charge portals 130/136 with one or more insulating members. As another example, embodiments in which connector portion 124 is located outside of the kiln may have a second charge entry portal and a second charge exit portal, both with insulating members. In any case, the insulating members may help to prevent loss of heat and steam, allowing more of the heat and steam from second chamber 120 to flow to first chamber 110.

In some examples, an insulating member of a charge portal may be selectively actuable to open as a lumber charge reaches the portal and to close again once the lagging end of the lumber charge has proceeded through the portal. In a particular embodiment, one or more sensors may be provided along the reciprocal flow path to detect a position of a lumber charge. A computing system receiving data from the sensors may control operation of any or all of the charge portals based on sensor data and other factors (e.g., drying schedule, conditions within the drying chamber, rate of lumber charge travel, etc.) This may improve energy efficiency and/or aid in the flow of moist heated air from second chamber 120 to flow toward first chamber 110. Alternatively, one or more of the charge portals may be provided with an insulating member configured to be pushed aside by the passage of a lumber charge (e.g., a polymer curtain, a vertical strip curtain, or swinging doors). As another alternative, one or more charge portals may be selectively actuated or controlled to open and/or close at predetermined intervals or times, or once a predetermined length of time has elapsed after a particular event (e.g., after opening/closing an upstream charge portal, after detection of a lumber charge near a charge portal, etc.).

FIGS. 3A-D illustrate more detailed plan views of the kilns of FIGS. 1A-D, in accordance with various embodiments. In these examples, chamber 110 includes subsections 10*a* and 10*b*, chamber 120 includes subsections 12*a*, 12*b*, 12*c*, and 12*d*, and chamber 140 (FIGS. 3A, 3B) includes subsection 14. Fans 170 may be provided some or all of the chambers/subsections and positioned to circulate air around the lumber charges. Fans 170 may be coupled to corresponding drives 174.

Some chambers, sections, or subsections may optionally be separated by one or more baffles 118 (indicated by broken lines). Baffles 118 may reduce the loss of heat and steam from charge portals 112 and 114 by reducing the migration of moist, heated air between adjacent subsections (e.g., reduce migration of air from subsection 10*b* to subsection 10*a*). This may increase the efficiency of pre-heating/cooling in chamber 110 and aid temperature regulation in adjacent chambers/subsections by minimizing fluctuations in temperature within those areas. Minimizing temperature fluctuations and reducing the migration of moisture between adjacent subsections may allow the green lumber to be pre-heated/cooled at a selected optimal rate, which may help to reduce or prevent defects from overly rapid drying or cooling of the lumber. Other embodiments may include additional subsections, fewer subsections, or no subsections.

Figure 3A:
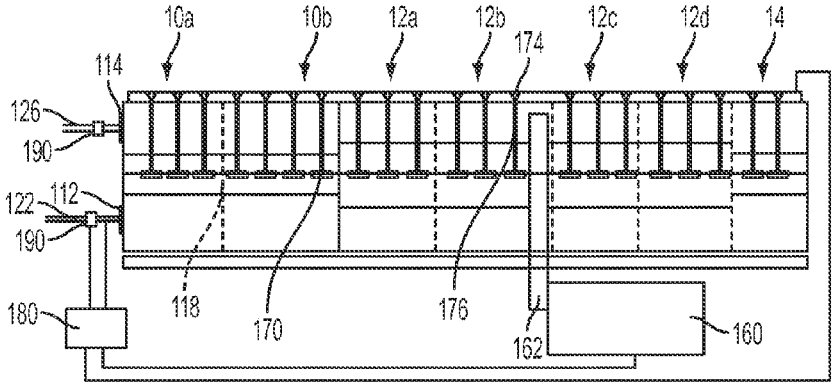
FIGS. 3A-D illustrate more detailed plan views of multi-pass kilns as illustrated in FIGS. 2A-D.
Figure 3B:
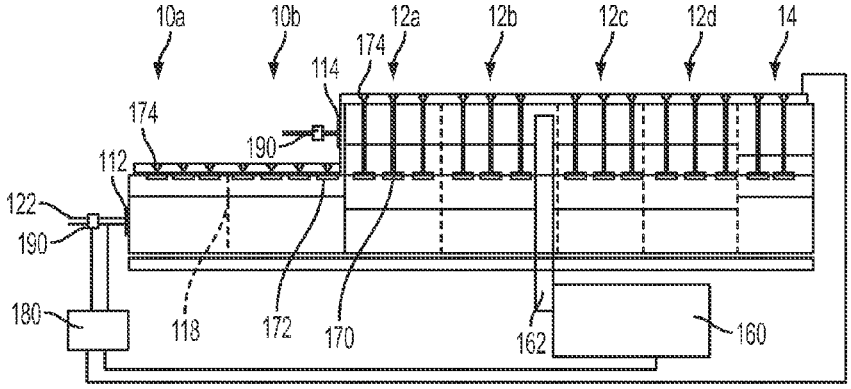
Figure 3C:
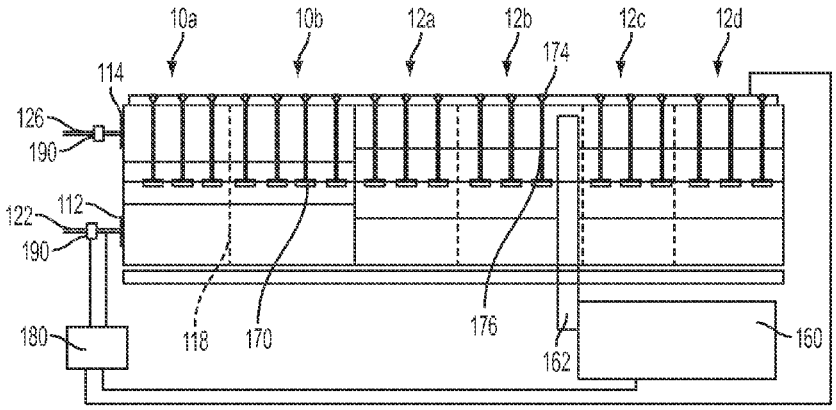
Figure 3D:
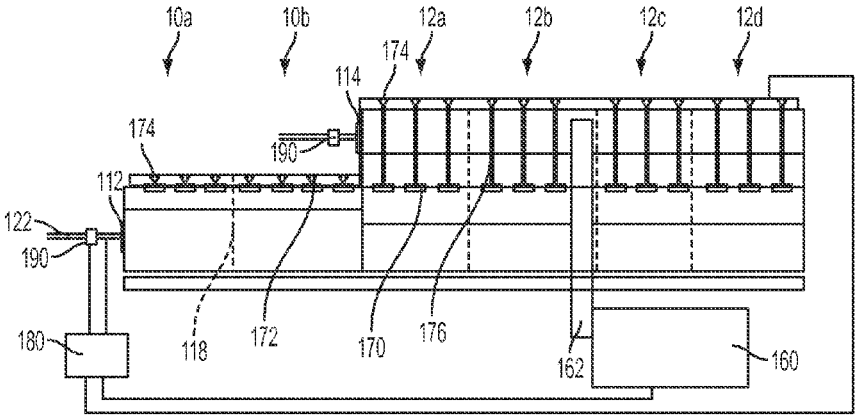

Subsections 10*a* and 10*b* may include subsections one or more fans 170 positioned to circulate air and steam received from chamber 120 around lumber charges proceeding through first chamber 110, a first preheat side that includes first charge entry portal 112, and a second cooling side that includes first charge exit portal 114 (FIGS. 3A, 3C). Within first chamber 110, fans 170 may circulate air across dried lumber progressing along the cooling side toward first charge exit portal 114 and across green lumber progressing in the opposite direction along the preheat side. In other embodiments, first chamber 110 (e.g., subsections 10*a* and 10*b*) may lack the preheat side or the cooling side and the corresponding charge portal (FIGS. 3B, 3D). In either case, fans 170 may circulate air across the lumber charges to preheat or cool/condition the lumber.

Subsections 12*a*, 12*b*, 12*c*, and 12*d* of second section 120 may be supplied with heated air by a fan and duct system 162 coupled to a heater 160. Any or all of subsections 12*a-d* may include heating members, as are known in the art, to maintain or increase the temperature of the circulating air. Optionally, one or more heating members may be provided in first chamber 110 and/or third chamber 140. These heating members may be selectively controlled to maintain a desired temperature within a chamber, section, or subsection, or a desired temperature differential between adjacent chambers, sections, or subsections.

The influx of heated air and the higher temperatures within section 120 may result in a pressure differential between section 120 and the first charge portals 112 and 114. The first charge exit portal 114 and the first charge entry portal 112 may be the primary, or the only, source of ventilation. Thus, because the exit and entry portals are located between first chamber 110 and second chamber 120, the pressure differential may enhance the flow of heat and moisture in one direction (i.e., from second chamber 120 toward the proximal end of first chamber 110) and reduce or inhibit the flow of heat and moisture in the opposite direction (i.e., from second chamber 120 toward the distal end of kiln 100). This design may provide more efficient preheating/conditioning of lumber than in prior continuous kilns with charge portals at both ends.

Third section 140 (e.g., subsection 14) may have one or more fans 170. Typically, third section 140 lacks a heater device. However, in some embodiments, third section 140 may include one or more heating members. Alternatively, fan and duct system 162 may release heated air directly into third section 140, and the heated air may flow from third section 140 to second section 120. Again, some embodiments may lack a third section 140.

Optionally, fans 170 may be reversible fans configured to rotate in two opposite rotary directions. Likewise, drives 174 may be reversible drives (i.e., configured to drive fans 170 in two opposite rotary directions). However, because kiln 100 has a unidirectional pressure gradient and a reciprocal flow path, fans 170 and/or drives 174 may be unidirectional instead of reversible. Using unidirectional fans/drives may reduce costs and/or energy use associated with operating kiln 100.

In one embodiment, fans 170 within second chamber 120 and/or third chamber 140 may be operated at a greater rotational speed than fans within first chamber 110. As a result, the velocity of circulating air may be greater in second chamber 120 and/or third chamber 140 than in first chamber 110. The air velocity may be progressively reduced among subsections nearer to the first charge portals 112/114.

In operation, a first stack of green lumber is placed on a movable support 190, and transport assembly 150 pushes or pulls movable support 190 into a first end of kiln 100 through first charge entry portal 112 along first portion 122 of the reciprocal flow path. In embodiments that have a first chamber 100 with a pre-heat side, the green lumber is pre-heated by condensation of the steam produced in, and flowing from, second chamber 120 as movable support 190 proceeds toward second chamber 120. The condensation of the steam transfers heat to the cool green lumber, raising the temperature of th The green lumber may continue to be heated and lose moisture as movable support 190 proceeds through the first side of second chamber 120.

As the green lumber proceeds onto and along connector portion 124, the green lumber may continue to be heated/dried at the same or similar rate. Alternatively, the green lumber may be heated or dried at an increased rate/temperature or at a reduced rate/temperature along connector portion 124. For example, in embodiments with a third chamber 140, the temperature within third chamber 140 may be slightly less than the temperature within second chamber 120. This may allow the green lumber to reach a more uniform temperature or moisture content (e.g., reduce the difference between the outer surface temperature/moisture and interior temperature/moisture). Alternatively, in embodiments that provide the heat/heated air to third chamber 140 directly, the green lumber may be heated at an increased rate/temperature while proceeding along connector portion 124 in third chamber 140.

The lumber may then proceed along connector portion 124 from the first side of kiln 100 to the second side of kiln 100, as described above. Once on the second side of kiln 100, the lumber may proceed along second portion 126, through the second side of kiln 100, toward the proximal end of kiln 100. As the lumber moves through second chamber 120 for the second time, the moisture content of the lumber may be further reduced. Fans 170 may be oriented or rotated such that the circulating air flows through/around lumber charges on the first side of second chamber 120 before flowing through/around lumber charges on the second side of second chamber 120 and back to the fans. Alternatively, fans 170 may be oriented or rotated in the opposite direction, such that the circulating air flows through/around lumber charges on the second side of second chamber 120 before flowing through/around lumber charges on the first side of second chamber 120 and back to the fans. The lumber may proceed along second portion 126 on the second side of kiln 100 until the lumber exits second chamber 120.

In some embodiments, first chamber 110 may have a width that is less than the width of second chamber 120 (e.g., about half the width of that chamber). In those embodiments, first charge exit portal 114 may be located in a wall of second chamber 120, and the lumber may exit through this portal without further drying or conditioning within kiln 100. In those embodiments, the second pass through moisture-laden air in second chamber 120 and/or the equilibration of lumber temperature/moisture content within third chamber 140 may reduce or eliminate the need for additional cooling/conditioning within kiln 100. Benefits of this design may include lower construction costs and a reduced footprint, due to the smaller first chamber 110.

Alternatively, in other embodiments first chamber 110 may have a width that is substantially the same as the width of second chamber 120. In these embodiments, first chamber 110 may have a cooling/conditioning area on one side of first chamber 110. The lumber may proceed along second portion 126 into the cooling/conditioning area of first chamber 110 toward first charge exit portal 114. Fans 170 within first chamber 110 may circulate air around the lumber charges. The circulating air may become progressively cooler as the lumber moves toward first charge exit portal 114. As a result, the lumber may release heat as it continues along the reciprocal flow path. Benefits of this design may include increased heat provided in the first chamber by the cooling lumber, and/or ease of construction.

As green lumber charges travel toward the distal end of the kiln in the first direction and on the first side of the kiln, dried lumber charges travel toward the proximal end or exit in the second direction on the second side of the kiln. The air circulated by the fans flows across the reciprocal flow path (first section 122 and second section 126) and through/around the dried lumber charges and the green lumber charges includes moist heated air flowing from second section 120 toward the entry and exit portals. As the dried lumber cools, it releases heat to the circulating air and gains moisture. The circulating air also preheats the green lumber, which releases moisture into the air. The green lumber encounters gradual increases in temperature and humidity, while the dried lumber traveling in the opposite direction encounters gradual decreases in temperature and humidity.

The travel time of the lumber charges may vary depending on various factors. The charges may be moved continuously along the reciprocal flow path. Optionally, the movable supports may be moved along the reciprocal flow path at a predetermined rate (e.g., 1-10 feet/hour, 3-7 feet/hour, 4-6 feet/hour, or 5 feet/hour). Alternatively, the charges may be moved discontinuously along the reciprocal flow path. This could be accomplished by moving the movable supports a desired distance, pausing for an interval of time, and moving the movable supports another desired distance. The distances may be incremental (e.g., increments of 1-5 feet, 2-4 feet, 3-6 feet, 1 foot, 2 feet, etc.).

The moisture content of the lumber charges may be monitored as the charges progress through the kiln. The rate at which the lumber charges are moved through the kiln and conditions within the chambers/subsections may be adjusted by a computing system based on factors such as initial moisture content of the lumber, humidity, temperature/pressure within a chamber, fan speeds, velocity of air flow, external ambient temperature/humidity, lumber species, lumber dimensions, desired moisture content, and/or input by a human operator.

In some embodiments, lumber charges may be organized into batches according to characteristics that affect drying time (e.g., dimensions, species, end use, starting moisture content, desired moisture content, desired drying speed, etc.). The charges of a particular batch may be fed sequentially into the kiln before feeding the charges of the next batch into the kiln. This may allow lumber charges to be fed into the kiln and moved along the reciprocal flow path at a substantially constant rate.

Figure 5:
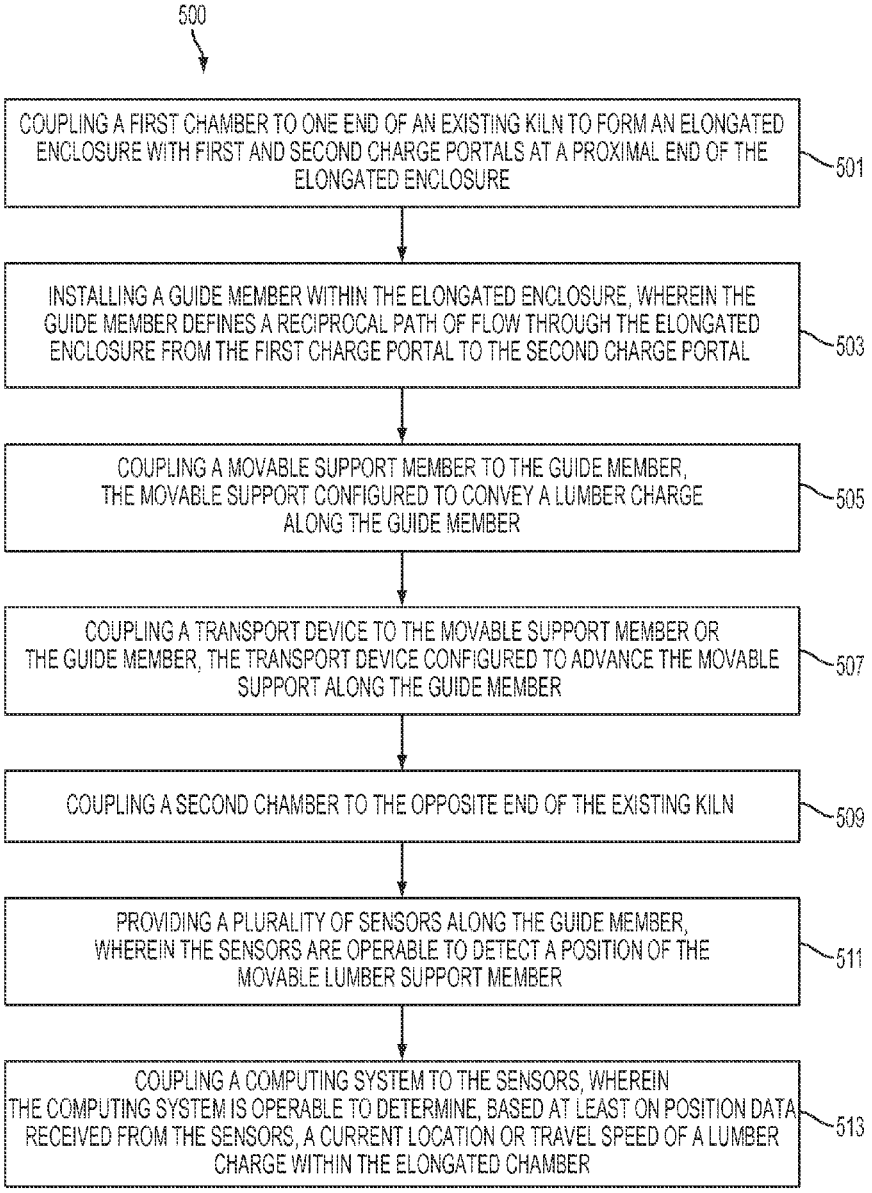
FIG. 5 is a flow diagram of a method for converting an existing kiln to a multi-pass kiln.

FIG. 5 is a flow diagram of a method for converting an existing kiln to a multi-pass kiln, in accordance with various embodiments.

In some embodiments, method 500 may begin at block 501. At block 501, a first chamber (e.g., chamber 110) may be coupled to one end of an existing kiln (e.g., second chamber 120) to form an elongated enclosure with first and second charge portals (e.g., charge portals 112, 114) at a proximal end of the elongated enclosure. At block 503, a guide member (e.g., guide member 108) may be installed within the elongated enclosure. The guide member may be, but is not limited to, a track with rails or other such features. The guide member may define a reciprocal path of flow through the elongated enclosure from the first charge portal to the second charge portal.

At block 505, a movable support/member (e.g., movable support 190) may be coupled to the guide member. In some embodiments, the movable support member may be configured to convey a lumber charge along the guide member.

At block 507, a transport device (e.g., transport assembly 150) may be coupled to the movable support member or the guide member. The transport device may be configured to advance the movable support along the guide member. In some embodiments, the transport device may include a pusher device, a motor, and/or a pulley/winch.

Optionally, at block 509 a second chamber may be coupled to the opposite end of the existing kiln (e.g., third chamber 140). In some embodiments, at block 511 a plurality of sensors may be provided along the guide member. The sensors may be operable to detect a position of the movable support member. In one embodiment, at block 513 a computing system may be coupled with the sensors. The computing system may be operable to determine, based at least on position data received from the sensors, a current location or travel speed of a lumber charge within the elongated chamber. In other embodiments, any or all of blocks 509, 511, and 513 may be omitted.

Figure 6:
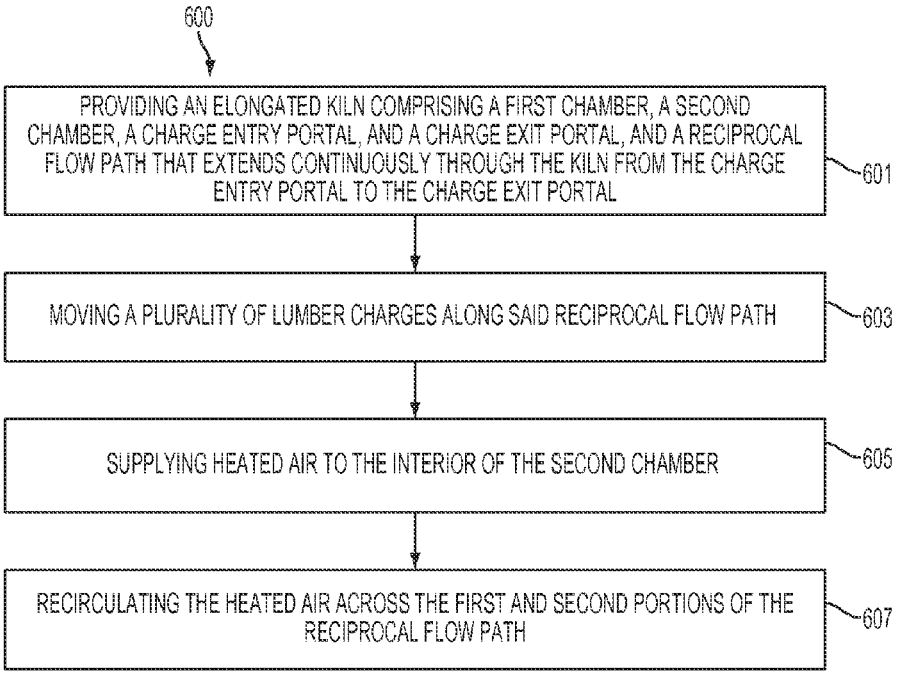
FIG. 6 is a flow diagram of a method for operating a multi-pass kiln.

FIG. 6 is a flow diagram of a method for operating a multi-pass kiln, all in accordance with various embodiments. In some embodiments, method 600 may begin at block 601. At block 601, an elongated kiln may be provided. The elongated kiln may include a first chamber (e.g., chamber 110), a second chamber (e.g., chamber 120), a charge entry portal and a charge exit portal (e.g., charge portals 112, 114), and a reciprocal flow path that extends continuously through the kiln from the charge entry portal to the charge exit portal. In some embodiments, the reciprocal flow path may have a first portion (e.g., 122) that extends through a first side of the elongated kiln, a second portion (e.g., 126) that extends through the kiln again on an opposite second side of the kiln, and a connector portion (e.g., 124) that extends between the first and second portions.

At block 603, a plurality of lumber charges may be moved along the reciprocal flow path. In some embodiments, the lumber charges may be moved in an end-to-end arrangement by a pusher device or other source of motive force as discussed herein. At block 605, heated air may be supplied to the interior of the second chamber. At block 607, the heated air may be recirculated across the first and second portions of the reciprocal flow path. The heated air may dry the lumber as the lumber charges progress through one side of the second chamber, along the connector portion, and then through the opposite side of the second chamber.

In addition to the discussion of various embodiments above, figures and additional discussion are presented herein to further describe certain aspects and various embodiments of the present invention. It is to be understood, however, that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A method for converting an existing kiln to a multi-pass kiln, comprising:

coupling at least a first chamber to the existing kiln to form an elongated enclosure with a first end that includes the first chamber, a generally opposite second end, and first and second sides defined by a longitudinal axis that extends through the first and second ends; and providing a guide member configured to guide a lumber charge at least partially through both of said sides of the elongated enclosure along a reciprocal path of flow, wherein a first portion of the guide member extends along the first side of the elongated enclosure, a generally parallel second portion of the guide member extends along the second side of the elongated enclosure, and a connector portion of the guide member extends between the first portion and the second portion across the longitudinal axis, wherein the connector portion is configured to guide the lumber charge from the first portion to the second portion, and the reciprocal path of flow has a first direction on from the first side and a generally opposite second direction on the the second side.

2. The method of claim 1, wherein the guide member is configured to engage a movable support on which the lumber charge is supported, the method further comprising coupling a transport device to the movable support or the guide member, the transport device configured to advance the movable support along the guide member.

3. The method of claim 2, wherein the transport device includes a pusher mechanism coupled to the guide member.

4. The method of claim 1, wherein a first end of the existing kiln includes one or more existing charge portals, and coupling at least the first chamber to the existing kiln includes coupling the first chamber to the first end of the existing kiln, such that the one or more existing charge portals are disposed between the first chamber and the second chamber.

5. The method of claim 1, wherein coupling at least the first chamber to the existing kiln includes coupling the first chamber to a first end of the existing kiln, the method further comprising coupling a second chamber to a generally opposite second end of the existing kiln, wherein the second end of the elongated enclosure includes the second chamber.

6. The method of claim 5, wherein the connector portion is disposed at least partially within the second chamber.

7. The method of claim 1, wherein the connector portion is curved.

8. The method of claim 1, wherein the connector portion is linear or curved and forms substantially congruent angles with the first and second portions of the guide member.

9. The method of claim 1, further comprising providing a plurality of sensors positioned along one or more of the portions of the guide member, wherein the sensors are operable to detect a position of the movable support.

10. The method of claim 9, further comprising operatively coupling a computing system with the sensors, wherein the computing system is operable to determine, based at least on position data received from the sensors, a current location or travel speed of the lumber charge along the one or more portions of the guide member.

11. The method of claim 10, wherein the guide member further includes a switching mechanism disposed at an intersection of the connector portion and the first or second portion, and wherein the computing system is further operable to control the switching mechanism based at least on the position data received from the sensors.

12. The method of claim 10, wherein coupling at least the first chamber with the existing kiln includes coupling the first chamber to a first end of the existing kiln, the method further including coupling an insulating member with a charge portal disposed in a generally opposite second end of the existing kiln, wherein the insulating member is configured to reduce airflow through the charge portal from the existing kiln.

13. The method of claim 12, wherein the insulating member is selectively actuable to open and close the charge portal, and the computing system is further operable to control the insulating member based at least on the position data received from the one or more sensors.

14. The method of claim 1, wherein the connector portion includes a carriage configured to support the lumber charge and an actuator coupled with the carriage, the actuator selectively actuable to move the carriage from a first position to a second position to thereby move the lumber charge from the first portion of the guide member to the second portion of the guide member.

15. The method of claim 1, wherein the second end of the elongate enclosure includes the existing kiln, and the connector portion is disposed at least partially within the existing kiln.

16. The method of claim 1, wherein the first and second portions of the guide member extend through the existing kiln and the second end, and the connector portion is disposed substantially outside of the elongate enclosure, such that the existing kiln is between the first chamber and the connector portion.

17. The method of claim 1, wherein coupling at least the first chamber with the existing kiln includes coupling the first chamber to a first end of the existing kiln, the method further including coupling an insulating member with a charge portal disposed in a generally opposite second end of the existing kiln, wherein the insulating member is configured to reduce airflow through the charge portal from the existing kiln.

18. The method of claim 17, wherein the insulating member is configured to be pushed away by passage of the lumber charge through the charge portal.

19. The method of claim 1, wherein the existing kiln includes one or more rails or tracks, and the one or more rails or tracks form some or all of the first or second portions of the guide member, and wherein providing the guide member includes coupling the connector portion with the one or more rails or tracks of the existing kiln.

* * * * *